US009371748B2

(12) United States Patent
Konishi et al.

(10) Patent No.: US 9,371,748 B2
(45) Date of Patent: Jun. 21, 2016

(54) HOLDING STRUCTURE OF OIL CONTROL VALVE

(71) Applicant: HONDA MOTOR CO., LTD., Tokyo (JP)

(72) Inventors: Yukio Konishi, Wako (JP); Hirotaka Ogino, Wako (JP); Takayuki Takatoku, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 57 days.

(21) Appl. No.: 14/535,323

(22) Filed: Nov. 7, 2014

(65) Prior Publication Data

US 2015/0128889 A1 May 14, 2015

(30) Foreign Application Priority Data

Nov. 8, 2013 (JP) ..... 2013-231663

(51) Int. Cl.
*F01L 1/34* (2006.01)
*F01L 1/344* (2006.01)

(52) U.S. Cl.
CPC ..... *F01L 1/3442* (2013.01); *F01L 2001/3443* (2013.01); *F01L 2001/34423* (2013.01); *F01L 2001/34433* (2013.01)

(58) Field of Classification Search
CPC ..... F01L 1/3442; F01L 2001/3443; F01L 2001/34423; F01L 2001/34433
USPC ..... 123/90.12, 90.15, 90.17
See application file for complete search history.

(56) References Cited

U.S. PATENT DOCUMENTS 6,289,861 B1 9/2001 Suzuki
7,594,488 B2 9/2009 Yoshijima et al.
8,051,820 B2 * 11/2011 Shoji ..... F01L 1/053 123/90.33

FOREIGN PATENT DOCUMENTS

JP 07-36082 Y2 2/1990
JP 3727362 11/1995
JP 2001-50102 2/2001
JP 4253635 B2 6/2006

* cited by examiner

*Primary Examiner* — Ching Chang
(74) *Attorney, Agent, or Firm* — Mori & Ward, LLP

(57) ABSTRACT

A holding structure of an oil control valve includes an oil control valve, a cam holder, and a head cover. A valve portion is provided on a second end side of the oil control valve opposite to a first end side in a longitudinal direction. The valve portion is configured to switch oil passages by driving a solenoid portion and has a drain hole at a shaft end portion of the valve portion. The cam holder is attached to a cylinder head of an internal combustion engine and rotatably supports a camshaft of the internal combustion engine. A valve portion side of the oil control valve is embedded in the cam holder and supported by the cam holder. An axis of the oil control valve in the longitudinal direction is oriented towards the camshaft. The head cover is provided on an upper portion of the cylinder head.

16 Claims, 7 Drawing Sheets

HOLDING STRUCTURE OF OIL CONTROL VALVE

CROSS-REFERENCE TO RELATED APPLICATIONS

The present application claims priority under 35 U.S.C. §119 to Japanese Patent Application No. 2013-231663, filed Nov. 8, 2013, entitled "Holding Structure of Oil Control Valve." The contents of this application are incorporated herein by reference in their entirety.

BACKGROUND

1. Field

The present disclosure relates to a holding structure of an oil control valve.

2. Description of the Related Art

A valve timing mechanism (a valve timing controller: VTC) used in a four-cycle reciprocating engine of a vehicle is known that is capable of varying valve timings (as well as lift amounts) of intake valves (as well as exhaust valves). Such a valve timing mechanism includes advance chambers and retard chambers. The valve timing mechanism is capable of, with application of oil pressure selectively to the advance chambers or the retard chambers, advancing or retarding the valve timing of the inlet valves (as well as the exhaust valves). An oil control valve (OCV) carries out driving of the valve timing mechanism with the application of oil pressure.

Japanese Patent No. 4253635 discloses a valve case, in which an oil control valve is mounted, provided on a cylinder head cover.

Japanese Unexamined Patent Application Publication No. 2001-50102 discloses two oil control valves disposed close to each other that are perpendicularly attached in the middle portion in the width direction between an intake camshaft and an exhaust camshaft of the integrally formed cam cap common to the intake camshaft and the exhaust camshaft.

Japanese Examined Utility Model Registration Application Publication No. 7-36082 discloses a switching valve that is attached to the upper surface of a cam holder, the switching valve being capable of switching between a communicating state and a shut-off state between an oil pressure supply passage and an oil supply port.

In the disclosure of Japanese Patent No. 3727362, a solenoid valve is mounted in a bearing cap of an intake shaft and a coil accommodation portion of the solenoid valve penetrates out through a cover portion of a head cover. Furthermore, at least a portion of the coil accommodation portion is positioned inside a plane of projection of an upper bulging portion of the head cover that is projected in a cam axial direction.

SUMMARY

According to one aspect of the present invention, a holding structure of an oil control valve includes an oil control valve, a cam holder, and a head cover. The oil control valve hydraulically drives a valve timing mechanism of an internal combustion engine. The oil control valve includes a solenoid portion to which a coupler is attached. The solenoid portion is provided on a first end side of the oil control valve in a longitudinal direction. A valve portion is provided on a second end side of the oil control valve in the longitudinal direction. The valve portion switches oil passages by driving of the solenoid portion and is formed with a drain hole at a shaft end portion of the valve portion. The cam holder is attached to a cylinder head of the internal combustion engine. The cam holder rotatably supports a camshaft of the internal combustion engine. The head cover is provided on an upper portion of the cylinder head. A valve portion side of the oil control valve is embedded in the cam holder and is supported by the cam holder. The solenoid portion is exposed to an outside of the internal combustion engine through an opening formed in the head cover. An axis of the oil control valve in the longitudinal direction is oriented towards the camshaft.

According to another aspect of the present invention, a holding structure of an oil control valve includes an oil control valve, a cam holder, and a head cover. The oil control valve is configured to hydraulically drive a valve timing mechanism of an internal combustion engine and includes a solenoid portion to which a coupler is attached. The solenoid portion is provided on a first end side of the oil control valve in a longitudinal direction of the oil control valve. A valve portion is provided on a second end side of the oil control valve opposite to the first end side in the longitudinal direction. The valve portion is configured to switch oil passages by driving the solenoid portion and has a drain hole at a shaft end portion of the valve portion. The cam holder is attached to a cylinder head of the internal combustion engine and rotatably supports a camshaft of the internal combustion engine. A valve portion side of the oil control valve is embedded in the cam holder and supported by the cam holder. An axis of the oil control valve in the longitudinal direction is oriented towards the camshaft. The head cover is provided on an upper portion of the cylinder head. The solenoid portion is exposed to an outside of the internal combustion engine through an opening provided in the head cover.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings.

DESCRIPTION OF THE EMBODIMENTS

Figure 1:
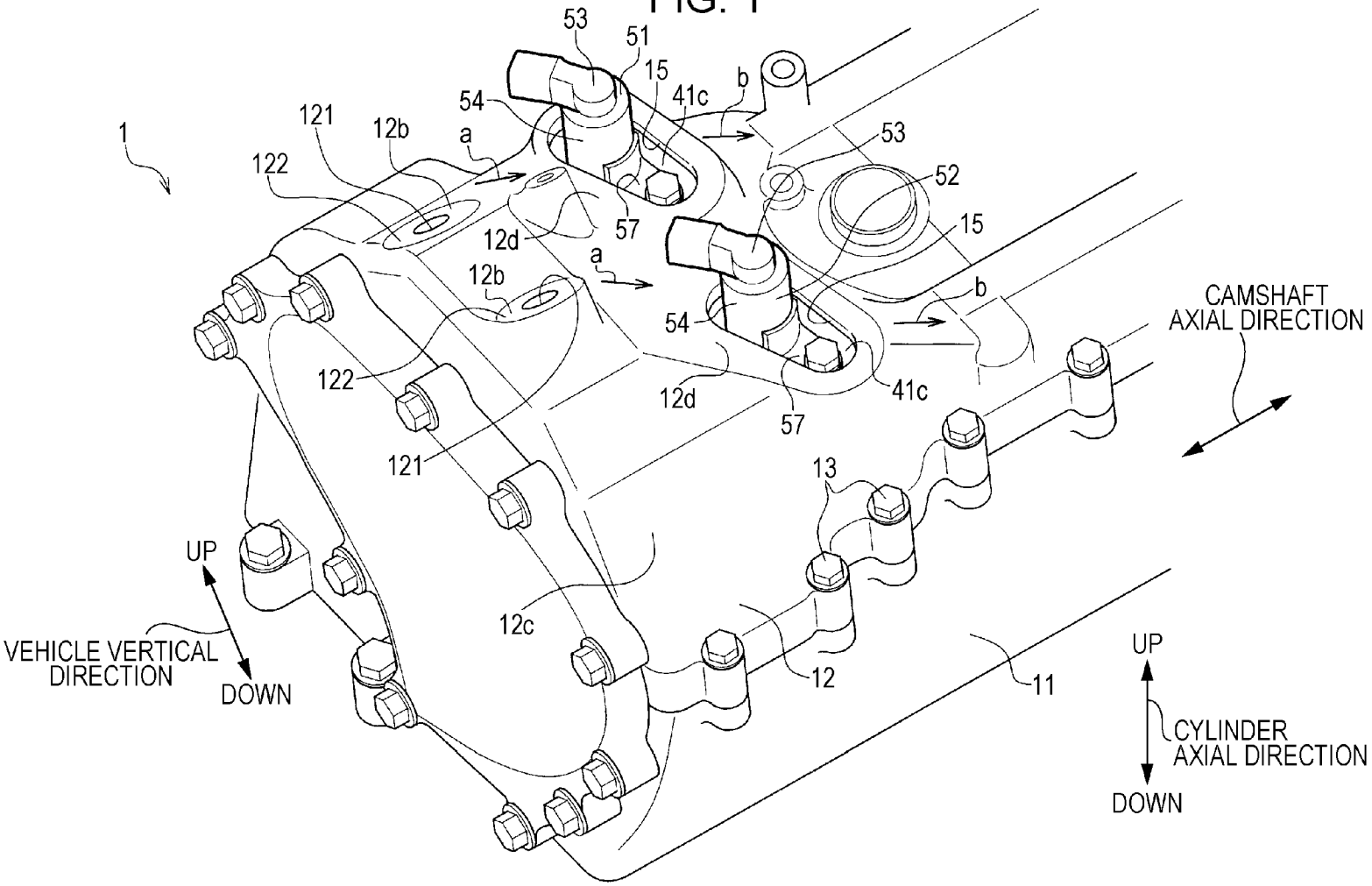
FIG. 1 is a perspective view partially illustrating an internal combustion engine for describing a holding structure of an oil control valve according to an exemplary embodiment of the present disclosure and illustrates a state in which a head cover is fastened onto a cylinder head of the internal combustion engine with bolts.

The embodiments will now be described with reference to the accompanying drawings, wherein like reference numerals designate corresponding or identical elements throughout the various drawings.

FIG. 1 is a perspective view illustrating a portion of an internal combustion engine for describing a holding structure of oil control valves according to the present exemplary embodiment. An internal combustion engine 1 is, for example, a V6 engine that is mounted on a vehicle. FIG. 1 and the following figures only illustrate an upper structure of one of the banks of the internal combustion engine 1. In other words, FIG. 1 and the following figures illustrate an upper portion of the internal combustion engine 1 on the side provided with a valve timing mechanism described later in the arrangement direction of the cylinders (not shown) of one of the banks of the internal combustion engine 1. A structure of an upper portion of the other bank of the internal combustion engine 1 corresponding to the above-described upper portion of the one of the banks of the internal combustion engine 1 has a substantially similar structure to that illustrated in FIG. 1 and the following figures. In FIG. 1 and the following figures, an axial direction of the cylinder of the internal combustion engine 1 (a cylinder axial direction), an axial direction of the camshaft described later (a camshaft axial direction), and the vertical direction of the vehicle when the internal combustion engine 1 is mounted on the vehicle (a vehicle vertical direction) are each indicated by an arrow as required. Note that in the following description, the upper direction and the lower direction are the upper direction and the lower direction, respectively, of the cylinder axial direction illustrated in FIG. 1 and the following figures. Furthermore, when the internal combustion engine 1 is mounted on the vehicle, the side on which the valve timing mechanism described later is disposed will be the front side of the vehicle.

Figure 2:
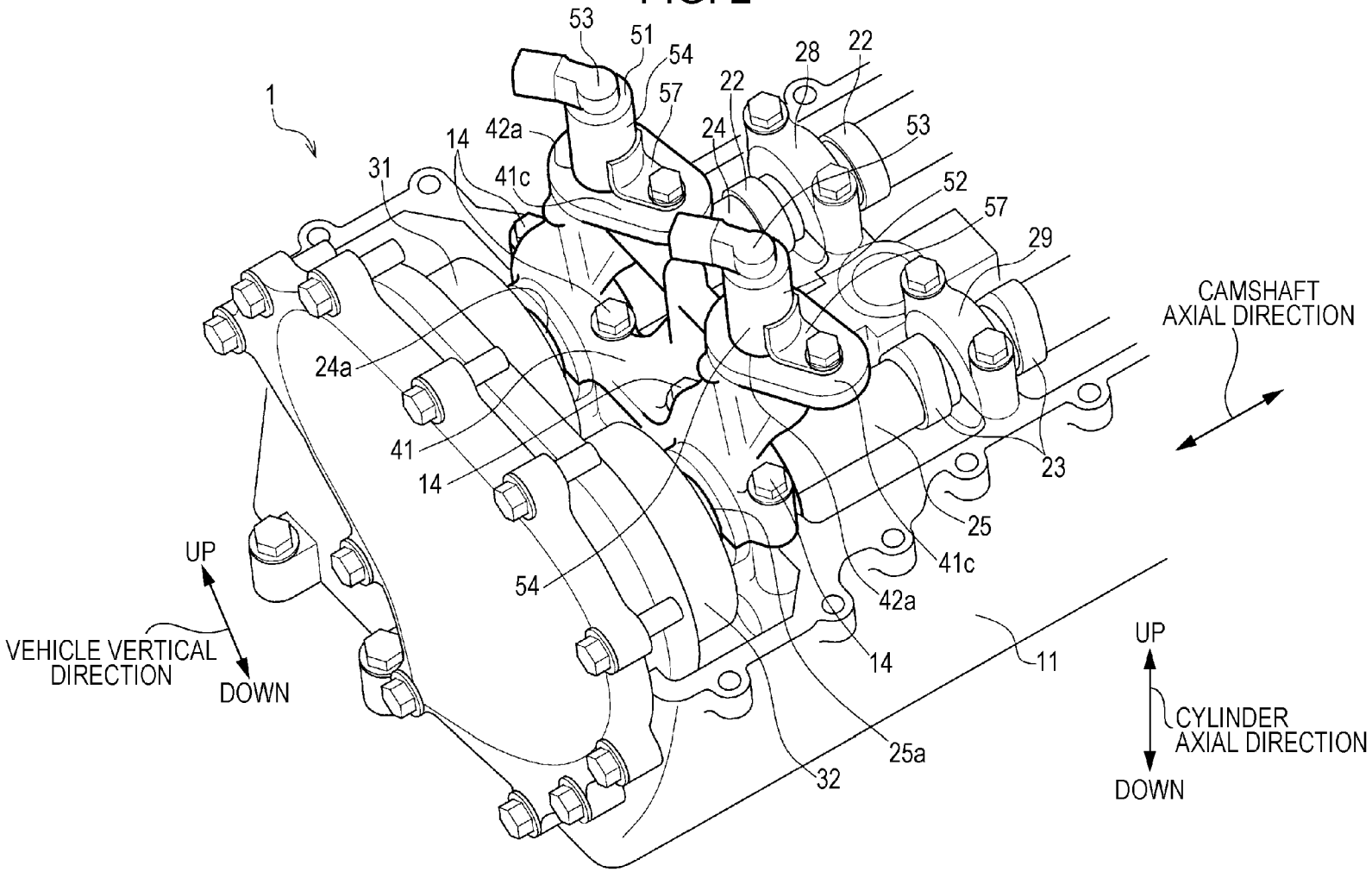
FIG. 2 is a perspective view partially illustrating the internal combustion engine for describing the holding structure of the oil control valve according to the exemplary embodiment of the present disclosure and illustrates a state in which the head cover is removed from the cylinder head.

FIG. 1 illustrates a perspective view in which a head cover 12 is fastened onto a cylinder head 11 with bolts 13. FIG. 2 illustrates a state in which the head cover 12 is dismounted from the state illustrated in FIG. 1.

Figure 3:
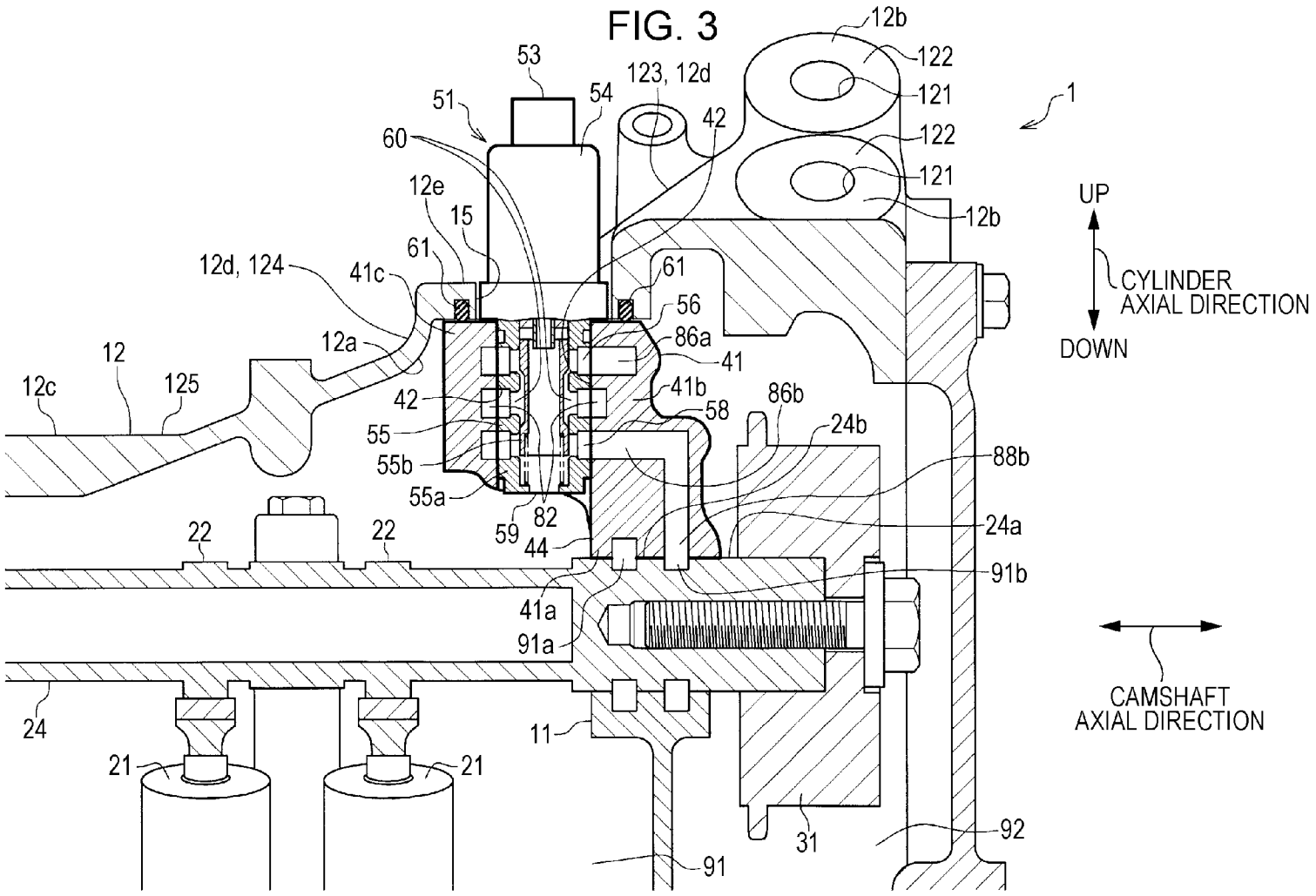
FIG. 3 is a cross-sectional view of the holding structure of the oil control valve according to the exemplary embodiment of the present disclosure cut in the cylinder axial direction along a line extending in the camshaft axial direction and through a position where the camshaft on the intake side of the combustion engine is positioned.

In the internal combustion engine 1, a camshaft 24 on the intake side and a camshaft 25 on the exhaust side that rotate cams 22 on the intake side and cams 23 on the exhaust side, respectively, for operating intake valves 21 (FIG. 3) and exhaust valves (not shown), respectively, of the cylinders (not shown) are provided in a valve chamber 91 (FIG. 3). In other words, the internal combustion engine 1 is a double overhead camshaft (DOHC) engine. Each of the camshafts 24 and 25 are supported by the cam holder 41 and the corresponding one of the cam holders 28 and 29 and are rotationally driven with a timing chain that transmits driving force of the internal combustion engine 1 generated on the crankshaft side (both not shown). The cam holders 41, 28, and 29 are fastened to the cylinder head 11 of the internal combustion engine 1 with bolts such as bolts 14 and rotatably support the camshafts 24 and 25 together with the cylinder head 11. A valve timing mechanism (valve timing controller: VTC) 31 on the intake side and a valve timing mechanism 32 on the exhaust side that are arranged in a chain chamber 92 (FIG. 3) of the internal combustion engine 1 are attached to a shaft end portion 24*a* of the camshaft 24 on the intake side and a shaft end portion 25*a* of the camshaft 25 on the exhaust side, respectively.

An oil control valve (OCV) 51 on the intake side and an oil control valve 52 on the exhaust side are attached to the cam holder 41 that is the closest cam holder to the valve timing mechanisms 31 and 32. The oil control valves 51 and 52 selectively supply oil that has been pressurized in an oil pump (not shown) to advance chambers or retard chambers (both not shown in detail) of each of the valve timing mechanisms 31 and 32 by switching oil passages. In other words, when the valve timing of the intake valves 21 and the valve timing of the exhaust valves (not shown) are to be advanced, oil is supplied to the advance chambers and when the valve timings thereof are to be retarded, oil is sent to the retard chambers. When oil is supplied to the advance chambers, the advance chambers become larger and the retard chambers become smaller, and oil is discharged from the retard chambers. When oil is supplied to the retard chambers, the retard chambers become larger and the advance chambers become smaller, and oil is discharged from the advance chambers. The oil discharged from the advance chambers and the retard chambers of the valve timing mechanisms 31 and 32 are discharged to an oil pan (not shown) side from the oil control valves 51 and 52. With the above, the oil control valves 51 and 52 hydraulically drive the valve timing mechanisms 31 and 32.

FIG. 3 is a cross-sectional view cut in the cylinder axial direction along a line extending in the camshaft axial direction and through a portion where the camshaft 24 on the intake side of the internal combustion engine 1 is positioned. In a cross-sectional view taken, in a similar manner to that of FIG. 3, along a portion where the camshaft 25 on the exhaust side is positioned, the camshaft 25, the cam holder 41, the oil control valve 52, and the valve timing mechanism 32 show similar cross-sectional shapes to those of FIG. 3 and, accordingly, illustration thereof of is omitted.

Each of the oil control valves 51 and 52 includes, at one end (the upper side) thereof in the longitudinal direction (the axial direction), a solenoid portion 54 to which a coupler 53 (FIGS. 1 and 2, for example) for supplying electric power is attached. Furthermore, as illustrated in FIG. 3, the other end (the lower side) of each of the oil control valves 51 and 52 in the longitudinal direction is provided with a valve portion 55 that switches the oil passages by driving the solenoid portion 54. Each of the valve portions 55 includes a cylindrical case 55*a* and a spool 55*b* that is slid inside the case in the longitudinal direction with the solenoid portion 54 (both not shown in detail). Each of the case 55*a* is provided with a retard opening 56, a supply hole 60, an advance opening 58, and a drain hole 59. In other words, each of the retard openings 56 that supplies oil to the retard chambers of the corresponding one of the oil control valves 51 and 52 is provided on the upper side of the corresponding case 55*a* in the longitudinal direction (on the solenoid portion 54 side), and each of the advance openings 58 that supplies oil to the advance chambers of the corresponding one of the oil control valves 51 and 52 is provided below the corresponding retard opening 56. Furthermore, each of the drain holes 59 is formed in the axial end portion of the corresponding valve portion 55. Each of the drain holes 59 is a hole for discharging oil, which has returned to the corresponding one of the oil control valves 51 and 52 after being discharged from the valve timing mechanisms 31 and 32, towards the oil pan (not shown) side. Furthermore, each of the supply holes 60 that is connected to a corresponding one of the oil supply passages 82 and 83 is provided in the middle of the retard opening 56 and the advance opening 58 of the corresponding case 55*a*. Moreover, the operation of each spool 55*b* actuated by the corresponding solenoid portion 54 allows the flow of oil supplied from the corresponding one of the oil supply passages 82 and 83 to be selectively switched towards the corresponding retard opening 56 side or towards the corresponding advance opening 58 side through the corresponding supply hole 60 (see FIG. 3).

Figure 6:
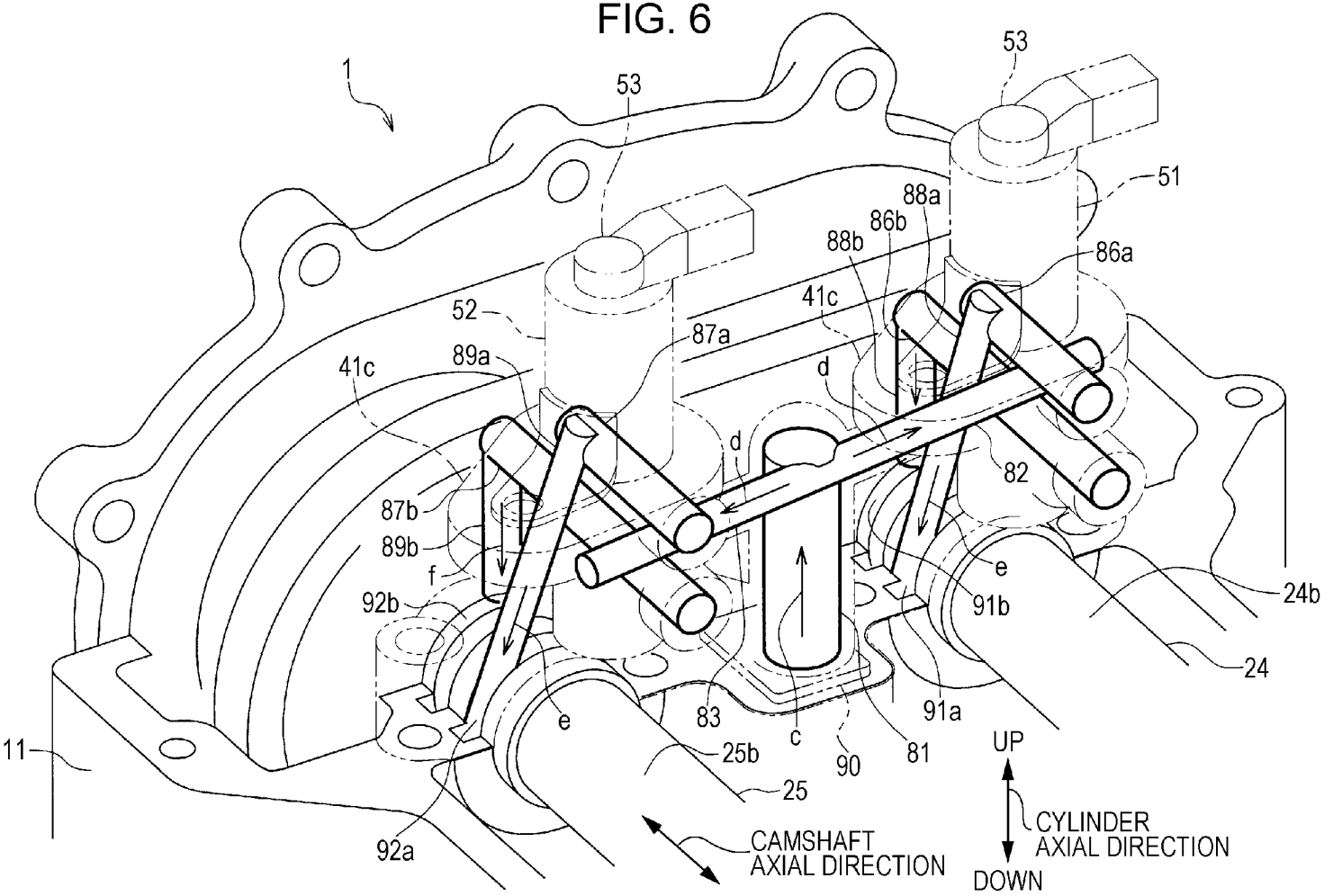
FIG. 6 is a diagram illustrating oil passages of the holding structure of the oil control valve according to the exemplary embodiment of the present disclosure.

As illustrated in FIGS. 2 and 3, the valve portion 55 sides of the oil control valves 51 and 52 are embedded in and are supported by the cam holder 41. Furthermore, the solenoid portions 54 are exposed to the outside of the internal combustion engine 1 through openings 15 formed in the head cover 12 (FIG. 1). Moreover, as illustrated in FIGS. 2, 3, and 6, the axes of the oil control valves 51 and 52 in the longitudinal direction are oriented towards the camshafts 24 and 25, respectively. Furthermore, the axes of the oil control valves 51 and 52 in the longitudinal direction are each arranged in the cylinder axial direction. Accordingly, the drain holes 59 at the axial ends of the oil control valves 51 and 52 are positioned in the vicinity of the camshafts 24 and 25 and vertically above the camshafts 24 and 25 such that the faces of the openings face the camshafts 24 and 25.

Figure 5:
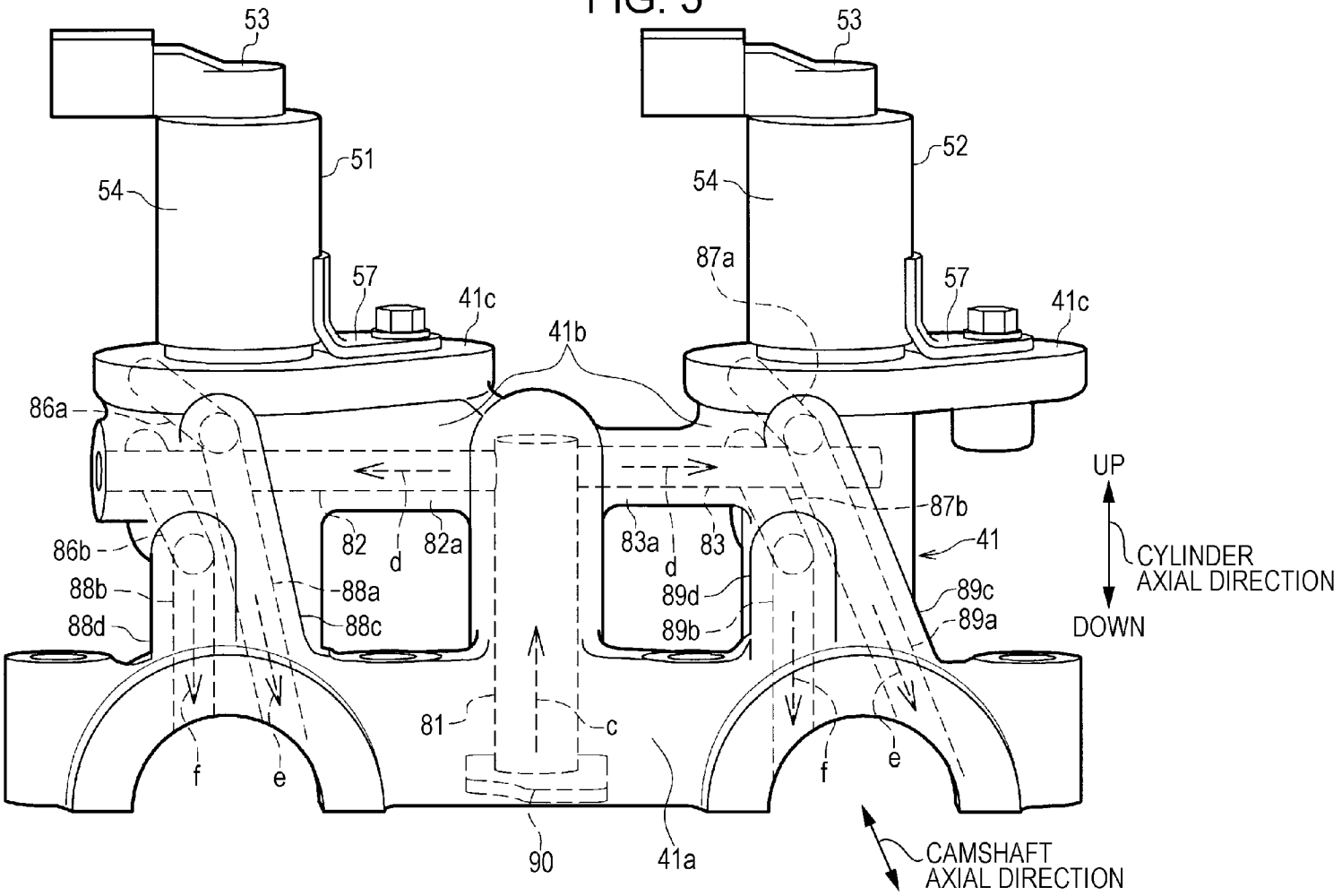
FIG. 5 is a diagram illustrating oil passages of cam holders of the holding structure of the oil control valve according to the exemplary embodiment of the present disclosure.

The cam holder 41 includes a base portion 41*a* that is fastened to the cylinder head 11 with bolts 14. Furthermore, the cam holder 41 includes support portions 41*b* that extend from the top of the base portion 41*a* and that incline in the camshaft axial direction towards the opposite side with respect to the valve timing mechanisms 31 and 32 side so as to support the oil control valves 51 and 52. Insertion holes 42 are formed in the support portions 41*b* so as to penetrate the support portions 41*b* in the cylinder axial direction. Each of the valve portions 55 of the oil control valves 51 and 52 is inserted into a corresponding one of the insertion holes 42. The length of each valve portion 55 is formed so as to be greater than the thickness of the support portions 41*b* where the insertion holes 42 are formed, and the axial end portions of the valve portions 55 protrude below the lower portion of the support portions 41*b*. Furthermore, as illustrated in FIGS. 3 and 5, the base portion 41*a* is a member that pivotally supports the camshafts 24 and 25, and the oil control valves 51 and 52 are provided adjacent to journal portions 24*b* and 25*b* of the camshafts 24 and 25, respectively, which the base portion 41*a* supports. As illustrated in FIG. 3, in the sections passing through the axes of the camshafts 24 and 25 and cut in the cylinder axial direction, an end face 44 of the base portion 41*a* in the camshaft axial direction, the base portion 41*a* supporting the journal portions 24*b* and 25*b* (also see FIG. 6) of the camshafts 24 and 25, is positioned so as to be aligned with the inner surfaces of the insertion holes 42 in a substantially straight line extending in the cylinder axial direction.

Figure 4:
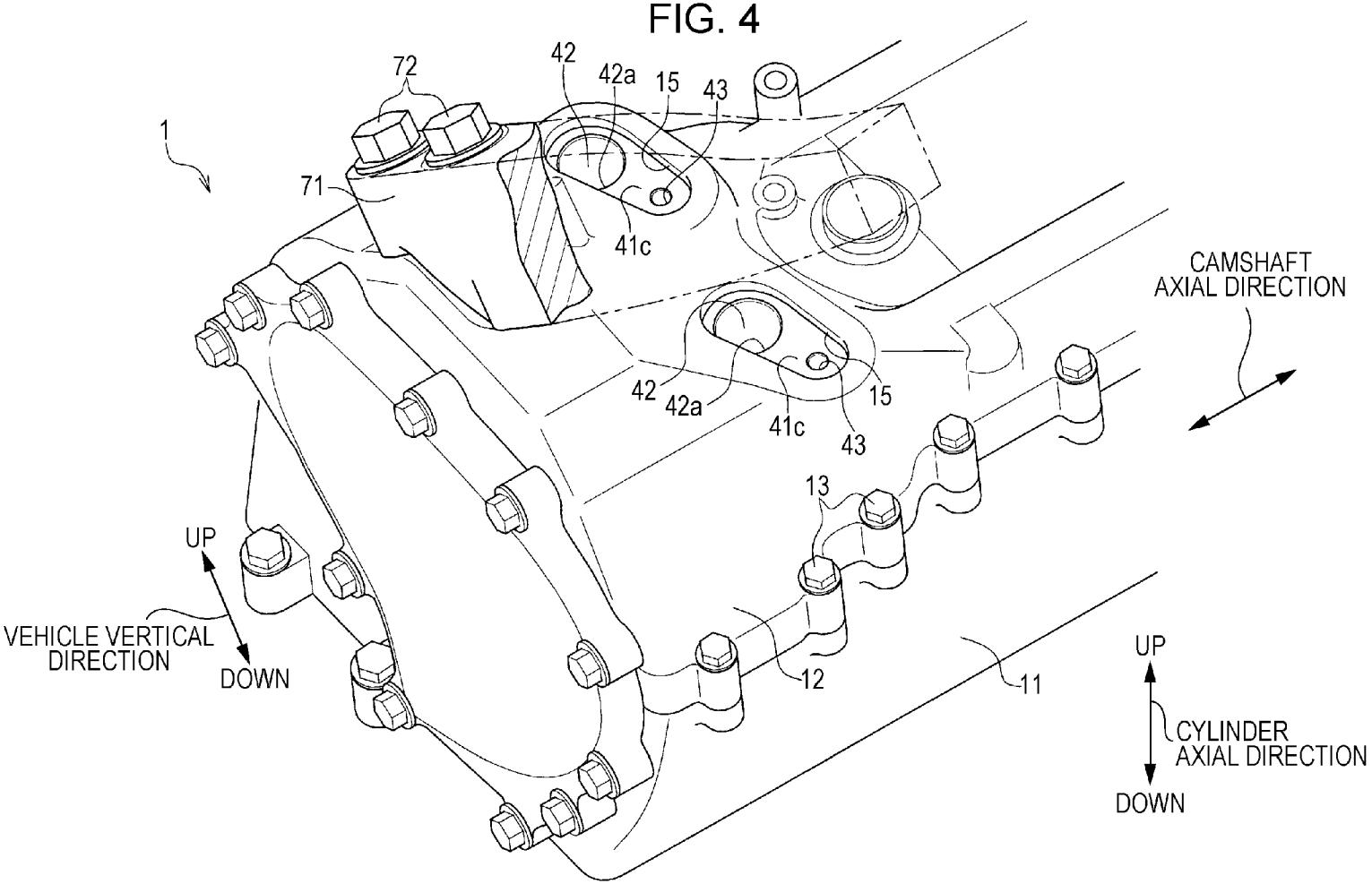
FIG. 4 is a perspective view illustrating an engine mount portion of the holding structure of the oil control valve according to the exemplary embodiment of the present disclosure.

As illustrated in the drawings including FIG. 2, flange portions 41*c* (FIGS. 2 and 3) are formed on the upper surface of the support portions 41*b* (FIG. 3). The upper surfaces of the flange portions 41*c* are flat surfaces that are orthogonal to the cylinder axial direction. The outer shape of each flange portion 41*c* is substantially oval in top view. As illustrated in FIG. 4, an opening 42*a* of the insertion hole 42 is open and a bolt hole 43 for fastening a bracket 57 is formed on each of the flange portions 41*c*. Each flange portion 41*c* is in contact with an inner surface 12*a* of the head cover 12 in an abutting state at a portion around the opening 42*a* and the bolt holes 43 through an elastic member 61 formed of a rubber packing or the like. Note that the brackets 57, which are attached to the oil control valves 51 and 52, bolted to the flange portions 41*c* fixes the oil control valves 51 and 52 to the cam holder 41.

Different from the cam holders 28 and 29, the cam holder 41 is a single piece of member serving as a bearing member shared by the camshaft 24 and the camshaft 25. The base portion 41*a* is shared by the camshaft 24 and the camshaft 25. Furthermore, the support portion 41*b* for the oil control valve 51 and the support portion 41*b* for the oil control valve 52 are aligned on the single piece of base portion 41*a* in a direction orthogonal to both the camshaft axial direction and the cylinder axial direction. As illustrated in FIG. 5, an oil supply passage portion 81*a* that is formed inside an oil supply passage 81 described later extends in the cylinder axial direction from a portion between the two support portions 41*b*. Oil supply passage portions 82*a* and 83*a* that are formed inside oil supply passages 82 and 83, respectively, described later extend from the oil supply passage portion 81*a* in a direction orthogonal to both the cylinder axial direction and the camshaft axial direction and are each connected to the corresponding support portion 41*b*. Ribs 88*c* and 89*c* for forming retard oil passages 88*a* and 89*a* described later are formed on the lateral side of the cam holder 41 on the valve timing mechanisms 31 and 32 side. In a similar manner, ribs 88*d* and 89*d* for forming advance oil passages 88*b* and 89*b* described later are formed on the lateral side of the cam holder 41. The ribs 88*c* and 89*c* are longer than the ribs 88*d* and 89*d*. The longitudinal direction of each of the ribs 88*d* and 89*d* extend in the cylinder axial direction while the ribs 88*c* and 89*c* are inclined with respect to the cylinder axial direction so as to avoid the ribs 88*d* and 89*d*. Furthermore, the ribs 88*d* and 89*d* are positioned on the valve timing mechanisms 31 and 32 side with respect to the ribs 88*c* and 89*c*.

The head cover 12 includes attaching portions 12*b* for attaching an engine mount portion 71 (FIG. 4) thereto by fastening bolts 72 to the engine mount portion 71. The attaching portions 12*b* are disposed in the head cover 12 at the side of the openings 15 in the camshaft axial direction and above the valve timing mechanisms 31 and 32 (FIGS. 1 and 2). At the above position, two attaching portions 12*b* are arranged with respect to each other in a direction orthogonal to both the camshaft axial direction and the cylinder axial direction. As illustrated in FIGS. 1 and 3, the attaching portions 12*b* each include a bolt hole 121 in the middle and a doughnut shaped flat surface 122 surrounding the bolt hole 121. The planner direction of the flat surface 122 is orthogonal to the vehicle vertical direction.

Furthermore, as illustrated in FIGS. 1 and 3, inclined surfaces 12*d* that each incline from the corresponding attaching portion 12*b* in the axial direction of the corresponding one of the camshafts 24 and 25 are formed on a surface 12*c* of the head cover 12 (FIG. 1 depicts the inclinations of the inclined surfaces 12*d* with arrows a and b). Moreover, the openings 15 described above are provided in the inclined surfaces 12*d*. The inclinations of the inclined surfaces 12*d* are inclinations with respect to the corresponding camshaft axial direction. The shape of the inclined surface 12*d* (123) when the internal combustion engine 1 is cut through the axis of the camshaft 24 and along a plane extending in the cylinder axial direction is illustrated in FIG. 3. In other words, a portion from each attaching portion 12*b* to the corresponding opening 15 is a linear downward slope. Furthermore, the edge portions of the openings 15 on the declining side of the inclined surfaces 12*d* are flat surfaces 12*e* extending in the camshaft axial direction. Moreover, an inclined surface 12*d* (124) continues from the flat surface 12*e* in a direction away from the valve timing mechanism 31. The inclined surface 12*d* (124) has an inclination that is steeper than the inclined surface 123 and that gradually becomes gentle as the inclined surface 12*d* (124) extends more towards the declining side such that, ultimately, the inclination is more gentle than that of the inclined surface 123. Furthermore, the end of the inclined surface 124 is connected to a flat surface 125 that is parallel to the camshaft axial direction and that is orthogonal to the cylinder axial direction. Note that each inclined surface 12*d* starts at a position that is on the valve timing mechanisms 31 and 32 side with respect to a half-length point of the internal combustion engine 1 in the camshaft axial direction.

Figure 7:
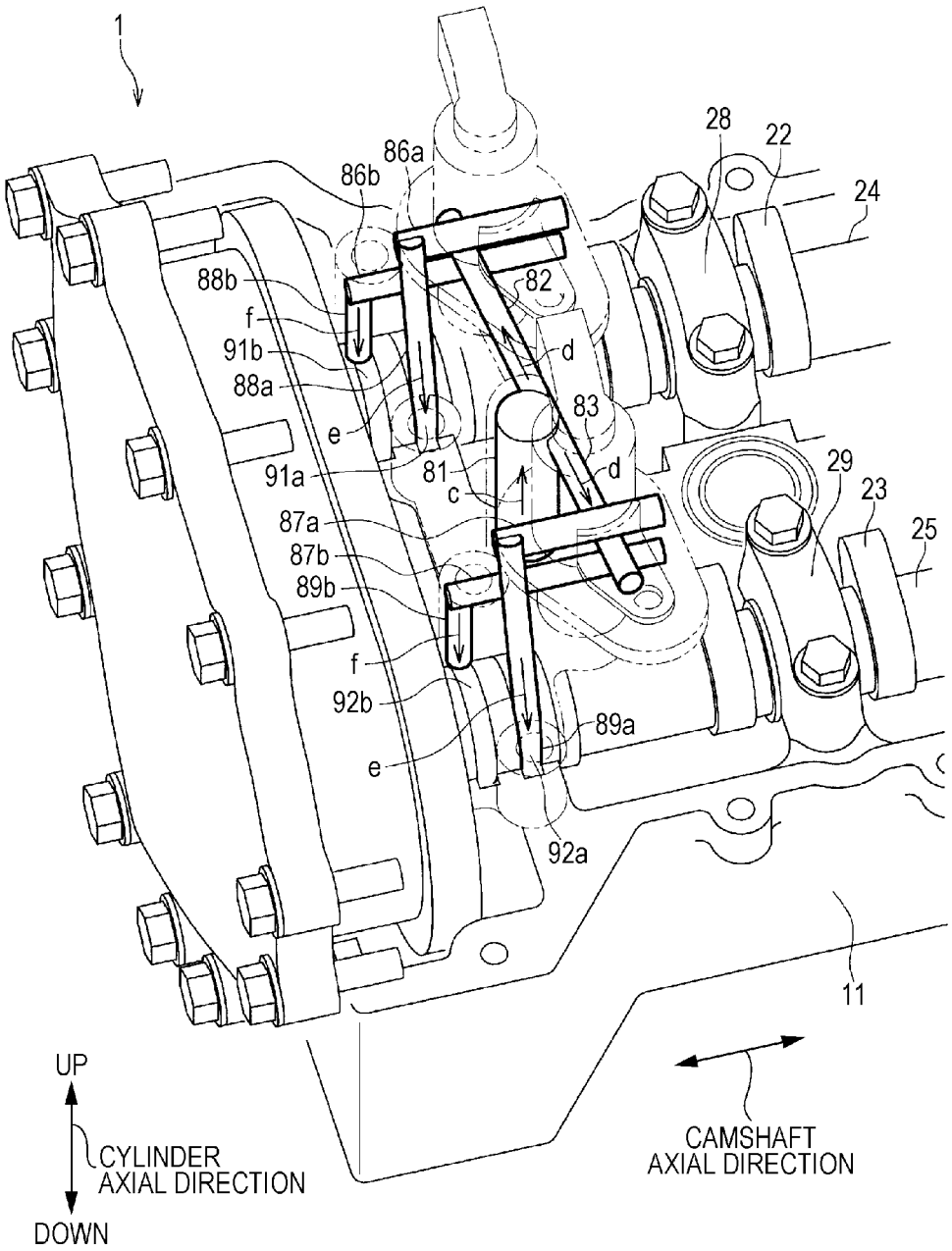
FIG. 7 is a diagram illustrating the oil passages of the holding structure of the oil control valve according to the exemplary embodiment of the present disclosure.

Oil passages provided in the above-described mechanism will be described next. FIGS. 5 to 7 are explanatory drawings illustrating the oil passages formed in the cam holder 41. The oil passages are depicted by broken lines in FIG. 5 and are depicted by solid lines in FIGS. 6 and 7. As illustrated in FIGS. 5 and 6, the oil supply passage 81 whose longitudinal direction extends in the cylinder axial direction is formed in the cam holder 41 between the two insertion holes 42. Oil flows in the oil supply passage 81 in the arrow c direction from an oil pump (not shown) and through an oil filter (not shown) on the cylinder block side of the internal combustion engine 1. Furthermore, an oil filter 90 is held between the cam holder 41 and the cylinder head 11 as well (FIGS. 5 and 6). The oil filter 90 is an oil filter for the oil control valves 51 and 52. In other words, the oil filter 90 is a filter for removing foreign matters produced in the oil passages (not shown) on the above-described cylinder block side downstream of the oil filter and for removing foreign matters that had not been removed completely.

Furthermore, as illustrated in FIGS. 5 to 7, the oil supply passage 81 is branched into the oil supply passage 82 that is oriented towards the oil control valve 51 side and the oil supply passage 83 that is oriented towards the oil control valve 52 side. Oil flows in the arrow d direction in each of the oil supply passages. Driving the solenoid portion 54 of the oil control valve 51 switches the spool 55*b* such that the oil supply passage 82 is selectively connected to a retard oil passage 86*a* or an advance oil passage 86*b*. In a similar manner, driving the solenoid portion 54 of the oil control valve 52 switches the spool 55*b* such that the oil supply passage 83 is selectively connected to a retard oil passage 87*a* or an advance oil passage 87*b*. In such a case, either one of the retard oil passage 86*a* and the advance oil passage 86*b* that had not been connected to the oil supply passage 82 is connected to the drain hole 59. In a similar manner, either one of the retard oil passage 87*a* and the advance oil passage 87*b* that had not been connected to the oil supply passage 83 is connected to the drain hole 59. Each of the retard oil passages 86*a* and 87*a* is connected to the corresponding retard opening 56 and each of the advance oil passages 86*b* and 87*b* is connected to the corresponding advance opening 58 (also see FIG. 3). Moreover, the retard oil passages 86*a* and 87*a* each serve as an oil passage that supplies oil to the retard chambers of the corresponding one of the valve timing mechanisms 31 and 32. The advance oil passages 86*b* and 87*b* on the lower side each serve as an oil passage that supplies oil to the advance chambers of the corresponding one of the valve timing mechanisms 31 and 32.

As illustrated in FIGS. 5 to 7, when oil is supplied to the advance chambers of the valve timing mechanisms 31 and 32 from the oil supply passages 82 and 83 sides, respectively, oil flows into the oil control valves 51 and 52. Then, oil flows into the advance oil passages 86*b* and 87*b* (first oil passages) that are connected to the advance openings 58 (FIG. 3) of the oil control valves 51 and 52 and in which the longitudinal directions thereof are the axial directions of the camshafts 24 and 25. Further, oil flows in the direction of the arrows f through the advance oil passages 88*b* and 89*b* (third oil passages) that are connected to the advance oil passages 86*b* and 87*b*, respectively. On the other hand, when oil is supplied to the retard chambers of the valve timing mechanisms 31 and 32 from the retard oil passages 86*a* and 87*a* sides, oil flows into the oil control valves 51 and 52 as well. In such a case, oil flows into the retard oil passages 86*a* and 87*a* (second oil passages) that are connected to the retard openings 56 (FIG. 3) of the oil control valves 51 and 52 and in which the longitudinal directions thereof are the axial directions of the camshafts 24 and 25. Further, oil flows into the directions of the arrow e through the retard oil passages 88*a* and 89*a* (fourth oil passages) that are connected to the retard oil passages 86*a* and 87*a*, respectively.

Furthermore, in the above case, the advance oil passages 88*b* and 89*b* are disposed closer to the valve timing mechanisms 31 and 32, respectively, in the camshaft axial direction with respect to the retard oil passages 88*a* and 89*a*, respectively.

As described above, only either one of the retard oil passage 86*a* and the advance oil passage 86*b* is selectively connected to the oil supply passage 82 and, in a similar manner, only either one of the retard oil passage 87*a* and the advance oil passage 87*b* is selectively connected to the oil supply passage 83. Note that in FIGS. 5 to 7, flows of oil of both connections are illustrated with the arrows e and f.

Furthermore, as illustrated in FIGS. 3, 6, and 7, the length of the advance oil passages 86*b* and 87*b* are longer than the length of the retard oil passages 86*a* and 87*a*. Furthermore, as illustrated in FIGS. 3, and 5 to 7, the length of the advance oil passages 88*b* and 89*b* are shorter than the length of the retard oil passages 88*a* and 89*a*. The longitudinal directions of the advance oil passages 88*b* and 89*b* that are connected to the advance chambers are the same as the axial directions of the oil control valves 51 and 52, respectively. Conversely, the retard oil passages 88*a* and 89*a* that are connected to the retard chambers are inclined with respect to the axial directions of the oil control valves 51 and 52, respectively, so as to avoid the advance oil passages 88*b* and 89*b* that are connected to the advance chambers.

As illustrated in FIGS. 3, 6, and 7, groove-shaped retard oil passages 91*a* and 92*a* that are connected to the retard oil passages 88*a* and 89*a*, respectively, are formed in the peripheral surfaces of the camshafts 24 and 25, respectively, and groove-shaped advance oil passages 91*b* and 92*b* that are connected to the advance oil passages 88*b* and 89*b*, respectively, are formed in the peripheral surfaces of the camshafts 24 and 25, respectively. The retard oil passages 91*a* and 92*a* supplies oil to the retard chambers side of the valve timing mechanisms 31 and 32, respectively, through oil passages (not shown) formed in the camshafts 24 and 25, respectively, on the valve timing mechanisms 31 and 32 sides, respectively. The advance oil passages 91*b* and 92*b* supplies oil to the advance chambers side of the valve timing mechanisms 31 and 32, respectively, through oil passages (not shown) formed in the camshafts 24 and 25, respectively, on the valve timing mechanisms 31 and 32 sides, respectively.

Oil discharged from the advance chambers of the valve timing mechanisms 31 and 32 returns to the oil control valves 51 and 52 through each of the oil passages that is in communication with the advance chambers and is discharged from the drain holes 59. Oil discharged from the retard chambers of the valve timing mechanisms 31 and 32 returns to the oil control valves 51 and 52 through each of the oil passages that is in communication with the retard chambers and is discharged from the drain holes 59. The oil drips to the camshafts 24 and 25 side and drops into the oil pan (not shown).

When oil is supplied to the advance chambers of the valve timing mechanisms 31 and 32, oil is returned to the oil control valves 51 and 52 side from the retard chambers. Furthermore, when oil is supplied to the retard chambers of the valve timing mechanisms 31 and 32, oil is returned to the oil control valves 51 and 52 side from the advance chambers. The above switching operations are carried out in the oil control valves 51 and 52. Note that in FIGS. 5 to 7, for convenience sake and in order to make clear the oil passages that supply oil to the advance chambers and the retard chambers of the valve timing mechanisms 31 and 32, the flows that supply oil to the advance chambers and the flows that supply oil to the retard chambers are illustrated by arrows at the same time.

Note that the above-described oil passages that supplies oil to the advance chambers may be interchanged with and used as the oil passages that supplies oil to the retard chambers, such that the oil passages that supplies oil to the advance chambers is configured as the oil passages that supplies oil to the retard chambers and such that the oil passages that supply oil to the retard chambers is configured as the oil passages that supplies oil to the advance chambers.

Effects of the present exemplary embodiment will be described next.

According to the holding structure of the oil control valve of the present exemplary embodiment described above, the oil control valves 51 and 52 are attached to the cam holder 41 while the valve portion 55 sides of the oil control valves 51 and 52 are embedded in the cam holder 41. Moreover, the axes of the oil control valves 51 and 52 are oriented towards the camshafts 24 and 25, respectively. Accordingly, the oil passages from the oil control valves 51 and 52 to the valve timing mechanisms 31 and 32, respectively, through the cam holder 41 and the corresponding one of the camshafts 24 and 25 can be relatively short such that responsiveness of the valve timing mechanisms 31 and 32 to oil pressure can be improved.

In the above case, the retard oil passages 86*a* and 87*a* that are oil passages on the retard side connected to the corresponding one of the retard openings 56 are relatively short and the advance oil passages 86*b* and 87*b* that are oil passages for advancing connected to the corresponding one of the advance openings 58 are relatively long. Conversely, the advance oil passages 88*b* and 89*b* that are oil passages on the advance side are relatively short with respect to the retard oil passages 88*a* and 89*a* that are oil passages on the retard side.

Accordingly, the lengths of the oil passages of the oil of the cam holder 41 flowing towards the advance chambers of the valve timing mechanisms 31 and 32 and the lengths of the oil passages of the oil flowing towards the retard chambers can be made uniform and variation in responsiveness of the valve timing mechanisms 31 and 32 between when performing an advance operation and a retard operation can be suppressed.

Furthermore, the advance oil passages 88*b* and 89*b* are disposed closer to the valve timing mechanisms 31 and 32, respectively, with respect to the retard oil passages 88*a* and 89*a*, respectively.

Accordingly, the advance oil passages 86*b* and 87*b* can be made longer than the retard oil passages 86*a* and 87*a*, and the advance oil passages 88*b* and 89*b* can be made shorter than the retard oil passages 88*a* and 89*a*, such that responsiveness of the valve timing mechanisms 31 and 32 to oil pressure can be improved.

Furthermore, the cam holder 41 includes the base portion 41*a* that is attached to the cylinder head 11, and the support portions 41*b* that extend from the top of the base portion 41*a* and that incline towards the opposite side with respect to the valve timing mechanisms 31 and 32 side so as to support the oil control valves 51 and 52, the valve timing mechanism 31 being attached to the shaft end portion 24*a* of the camshaft 24 and the valve timing mechanism 32 being attached to the shaft end portion 25*a* of the camshaft 25.

Accordingly, the oil control valves 51 and 52 do not get in the way and there is no problem in providing the required oil passages described above in the base portion 41*a*. Furthermore, since the base portion 41*a* is provided on the valve timing mechanisms 31 and 32 side, the oil passages from the oil control valves 51 and 52 to the valve timing mechanisms 31 and 32, respectively, can be made short so that responsiveness of the valve timing mechanisms 31 and 32 to oil pressure can be improved.

Furthermore, since the drain hole 59 is formed in the shaft end portion of each valve portion 55 and the axes of the oil control valves 51 and 52 are oriented towards the camshafts 24 and 25, respectively, the camshafts 24 and 25 can each be lubricated with the oil discharged from the corresponding drain hole 59.

Furthermore, since the oil control valves 51 and 52 are attached to the cam holder 41 while each of the valve portion 55 sides of the oil control valves 51 and 52 is embedded in the cam holder 41, the oil passages described above that are connected to the valve portions 55 can be provided in the cam holder 41 and the oil passages can be completed inside the head cover 12. Accordingly, the openings 15 formed in the head cover 12 can be reduced in size and the rigidity of the head cover 12 can be maintained at a high degree.

Furthermore, the oil control valves 51 and 52 are attached to the cam holder 41 that is fastened to the cylinder head 11 with bolts 14. Accordingly, compared with a case in which the oil control valves 51 and 52 are attached to, for example, the cylinder head 11, the rigidity of the mounting structure of the oil control valves 51 and 52 is high and vibration of the oil control valves 51 and 52 can be reduced resulting in suppression of malfunctions.

The oil control valves 51 and 52 are provided adjacent to the journal portions 24*b* and 25*b* of the camshafts 24 and 25 that are supported by the cam holder 41. Accordingly, the journal portions 24*b* and 25*b* of the camshafts 24 and 25 can be lubricated with the oil from the drain holes 59.

Furthermore, the cam holder 41 includes the flange portions 41*c* that are each in contact with the corresponding inner surface 12*a* of the head cover 12 in an abutting state around the embedded portion of the corresponding one of the oil control valves 51 and 52 through the corresponding elastic member 61. Accordingly, when the head cover 12 and the cylinder head 11 are attached to each other with bolts 13, the cam holder 41 comes in contact with the inner surface 12*a* of the head cover 12 in an abutting state through the elastic members 61; accordingly, adhesion between the cam holder 41 and the head cover 12 can be increased.

Furthermore, the head cover 12 includes the attaching portions 12*b* for attaching the engine mount portion 71 of the internal combustion engine 1 thereto, and includes inclined surfaces 12*d* that are each inclined with respect to the axial direction of the corresponding one of the camshafts 24 and 25 from the attaching portions 12*b*. The openings 15 are provided in the inclined surfaces 12*d*. Accordingly, stress concentration in the vicinity of the open portions 15 can be reduced.

An aspect of the present disclosure is a holding structure of an oil control valve, including: an oil control valve that hydraulically drives a valve timing mechanism of an internal combustion engine, the oil control valve including a solenoid portion to which a coupler is attached, the solenoid portion being provided on a first end side of the oil control valve in a longitudinal direction, and a valve portion provided on a second end side of the oil control valve in the longitudinal direction, the valve portion switching oil passages by driving of the solenoid portion and being formed with a drain hole at a shaft end portion of the valve portion; a cam holder that is attached to a cylinder head of the internal combustion engine, the cam holder rotatably supporting a camshaft of the internal combustion engine; and a head cover provided on an upper portion of the cylinder head. In the holding structure of the oil control valve, a valve portion side of the oil control valve is embedded in the cam holder and is supported by the cam holder, the solenoid portion is exposed to an outside of the internal combustion engine through an opening formed in the head cover, and an axis of the oil control valve in the longitudinal direction is oriented towards the camshaft.

According to the present disclosure, the oil control valve is attached to the cam holder while the valve portion side of the oil control valve is embedded in the cam holder, and the axis of the oil control valve is oriented towards the camshaft. Accordingly, the oil passage from the oil control valve to the valve timing mechanism through the cam holder and the camshaft can be made relatively short such that responsiveness of the valve timing mechanism to oil pressure can be improved.

Furthermore, since the drain hole is formed in the shaft end portion of the valve portion and the axis of the oil control valve is oriented towards the camshaft, the camshaft can be lubricated with the oil discharged from the drain hole.

Furthermore, since the oil control valve is attached to the cam holder while the valve portion side of the oil control valve is embedded in the cam holder, the oil passage that is connected to the valve portion can be provided in the cam holder and the oil passage can be completed inside the head cover. Accordingly, the opening formed in the head cover can be reduced in size and the rigidity of the head cover can be maintained at a high degree.

Furthermore, the oil control valve is attached to the cam holder that is fastened to the cylinder head. Accordingly, compared with a case in which the oil control valve is attached to, for example, the head cover, the rigidity of the mounting structure of the oil control valve is high and vibration of the oil control valve can be reduced resulting in suppression of malfunctions.

The oil control valve may be provided adjacent to a journal portion of the camshaft.

According to the present disclosure, the journal portion of the camshaft may be lubricated by the oil from the drain hole.

In the above case, the cam holder may include a flange portion that is in contact with an inner surface of the head cover in an abutting state at a portion around an embedded portion of the oil control valve through an elastic member.

According to the present disclosure, when the head cover and the cylinder head are attached to each other with bolts, the cam holder may come in contact with the inner surface of the head cover in an abutting state through the elastic member; accordingly, adhesion between the cam holder and the head cover may be increased.

In the above case, the head cover may include an attaching portion that attaches an engine mount portion of the internal combustion engine thereto and an inclined surface on a surface of the head cover, the inclined surface may be inclined with respect to an axial direction of the camshaft from the attaching portion, and the opening may be provided in the inclined surface.

According to the present disclosure, since the opening of the head cover may be provided in the inclined surface, stress concentration in the vicinity of the opening may be reduced.

In the above case, the valve portion may include an advance opening that supplies oil to an advance chamber of the valve timing mechanism, and a retard opening that supplies oil to a retard chamber of the valve timing mechanism, and the cam holder may include a first oil passage, a first end of which is connected to the advance opening or the retard opening, a longitudinal direction of the first oil passage being parallel to an axial direction of the camshaft, a second oil passage, a first end of which is connected to the advance opening or the retard opening, the second oil passage passing through a position that is closer to the camshaft than the first oil passage, a longitudinal direction of the second oil passage being parallel to the axial direction of the camshaft, a length of the second oil passage being longer than a length of the first oil passage, a third oil passage, one end of which is connected to a second end of the first oil passage, the third oil passage being connected to an oil passage in the camshaft that supplies oil to the advance chamber or the retard chamber, and a fourth oil passage, one end of which is connected to a second end of the second oil passage, the fourth oil passage being connected to an oil passage in the camshaft that supplies oil to the retard chamber of the advance chamber, the fourth oil passage being shorter than the third oil passage.

According to the present disclosure, the length of the oil passage of the oil of the cam holder flowing towards the advance chamber of the valve timing mechanism and the length of the oil passage of oil flowing towards the retard chamber may be made uniform such that the variation in the responsiveness of the valve timing mechanism between when performing an advance operation and a retard operation with the oil pressure may be suppressed.

In such a case, the cam holder may include a base portion attached to the cylinder head, and a support portion that extends from a top of the base portion and that inclines towards an opposite side with respect to a valve timing mechanism side, the valve timing mechanism being attached to one end of the camshaft, so as to support the oil control valve.

According to the present disclosure, the oil control valve does not get in the way and there is no problem in providing the required oil passage in the base portion. Furthermore, since the base portion may be provided on the valve timing mechanism side, the oil passage to the valve timing mechanism may be made short so that responsiveness of the valve timing mechanism to oil pressure may be improved.

In the above case, the fourth oil passage may be arranged closer to the valve timing mechanism with respect to the third oil passage.

According to the present disclosure, the first oil passage can be made shorter than the second oil passage, and the third oil passage can be made longer than the fourth oil passage, such that responsiveness of the valve timing mechanism to oil pressure can be improved.

Obviously, numerous modifications and variations of the present invention are possible in light of the above teachings. It is therefore to be understood that within the scope of the appended claims, the invention may be practiced otherwise than as specifically described herein.

What is claimed is:

1. A holding structure of an oil control valve, comprising:

an oil control valve that hydraulically drives a valve timing mechanism of an internal combustion engine, the oil control valve including a solenoid portion to which a coupler is attached, the solenoid portion being provided on a first end side of the oil control valve in a longitudinal direction, and a valve portion provided on a second end side of the oil control valve in the longitudinal direction, the valve portion switching oil passages by driving of the solenoid portion and being formed with a drain hole at a shaft end portion of the valve portion;

a cam holder that is attached to a cylinder head of the internal combustion engine, the cam holder rotatably supporting a camshaft of the internal combustion engine; and a head cover provided on an upper portion of the cylinder head, wherein a valve portion side of the oil control valve is embedded in the cam holder and is supported by the cam holder, the solenoid portion is exposed to an outside of the internal combustion engine through an opening formed in the head cover, and an axis of the oil control valve in the longitudinal direction is oriented towards the camshaft.

2. The holding structure according to claim 1, wherein the oil control valve is provided adjacent to a journal portion of the camshaft.

3. The holding structure according to claim 1, wherein the cam holder includes a flange portion that is in contact with an inner surface of the head cover in an abutting state at a portion around an embedded portion of the oil control valve through an elastic member.

4. The holding structure according to claim 1, wherein the head cover includes an attaching portion that attaches an engine mount portion of the internal combustion engine thereto and an inclined surface on a surface of the head cover, the inclined surface being inclined with respect to an axial direction of the camshaft from the attaching portion, and the opening being provided in the inclined surface.

5. The holding structure according to claim 1, wherein the valve portion includes an advance opening that supplies oil to an advance chamber of the valve timing mechanism, and a retard opening that supplies oil to a retard chamber of the valve timing mechanism, and the cam holder includes a first oil passage, a first end of which is connected to the advance opening or the retard opening, a longitudinal direction of the first oil passage being parallel to an axial direction of the camshaft, a second oil passage, a first end of which is connected to the advance opening or the retard opening, the second oil passage passing through a position that is closer to the camshaft than the first oil passage, a longitudinal direction of the second oil passage being parallel to the axial direction of the camshaft, a length of the second oil passage being longer than a length of the first oil passage, a third oil passage, one end of which is connected to a second end of the first oil passage, the third oil passage being connected to an oil passage in the camshaft that supplies oil to the advance chamber or the retard chamber, and a fourth oil passage, one end of which is connected to a second end of the second oil passage, the fourth oil passage being connected to an oil passage in the camshaft that supplies oil to the retard chamber of the advance chamber, the fourth oil passage being shorter than the third oil passage.

6. The holding structure according to claim 5, wherein the cam holder includes a base portion attached to the cylinder head, and a support portion that extends from a top of the base portion and that inclines towards an opposite side with respect to a valve timing mechanism side, the valve timing mechanism being attached to one end of the camshaft, so as to support the oil control valve.

7. The holding structure according to claim 5, wherein the fourth oil passage is arranged closer to the valve timing mechanism with respect to the third oil passage.

8. A holding structure of an oil control valve, comprising:

an oil control valve configured to hydraulically drive a valve timing mechanism of an internal combustion engine and including a solenoid portion to which a coupler is attached, the solenoid portion being provided on a first end side of the oil control valve in a longitudinal direction of the oil control valve, a valve portion being provided on a second end side of the oil control valve opposite to the first end side in the longitudinal direction, the valve portion being configured to switch oil passages by driving the solenoid portion and having a drain hole at a shaft end portion of the valve portion;

a cam holder attached to a cylinder head of the internal combustion engine and rotatably supporting a camshaft of the internal combustion engine, a valve portion side of the oil control valve being embedded in the cam holder and supported by the cam holder, an axis of the oil control valve in the longitudinal direction being oriented towards the camshaft; and a head cover provided on an upper portion of the cylinder head, the solenoid portion being exposed to an outside of the internal combustion engine through an opening provided in the head cover.

9. The holding structure according to claim 8, wherein the oil control valve is provided adjacent to a journal portion of the camshaft.

10. The holding structure according to claim 8, wherein the cam holder includes a flange portion that is in contact with an inner surface of the head cover in an abutting state at a portion around an embedded portion of the oil control valve through an elastic member.

11. The holding structure according to claim 8, wherein the head cover includes an attaching portion that attaches an engine mount portion of the internal combustion engine thereto and an inclined surface on a surface of the head cover, the inclined surface being inclined with respect to an axial direction of the camshaft from the attaching portion, and the opening being provided in the inclined surface.

12. The holding structure according to claim 8, wherein the valve portion includes an advance opening that supplies oil to an advance chamber of the valve timing mechanism, and a retard opening that supplies oil to a retard chamber of the valve timing mechanism, and the cam holder includes a first oil passage, a first end of which is connected to the advance opening or the retard opening, a longitudinal direction of the first oil passage being parallel to an axial direction of the camshaft, a second oil passage, a first end of which is connected to the advance opening or the retard opening, the second oil passage passing through a position that is closer to the camshaft than the first oil passage, a longitudinal direction of the second oil passage being parallel to the axial direction of the camshaft, a length of the second oil passage being longer than a length of the first oil passage, a third oil passage, one end of which is connected to a second end of the first oil passage, the third oil passage being connected to an oil passage in the camshaft that supplies oil to the advance chamber or the retard chamber, and a fourth oil passage, one end of which is connected to a second end of the second oil passage, the fourth oil passage being connected to an oil passage in the camshaft that supplies oil to the retard chamber or the advance chamber, the fourth oil passage being shorter than the third oil passage.

13. The holding structure according to claim 12, wherein the cam holder includes a base portion attached to the cylinder head, and a support portion that extends from a top of the base portion and that inclines towards an opposite side with respect to a valve timing mechanism side, the valve timing mechanism being attached to one end of the camshaft, so as to support the oil control valve.

14. The holding structure according to claim 12, wherein the fourth oil passage is arranged closer to the valve timing mechanism with respect to the third oil passage.

15. The holding structure according to claim 8, wherein the cam holder includes a base portion attached to the cylinder head, and a support portion that extends from a top of the base portion and that inclines towards an opposite side with respect to a valve timing mechanism side, the valve timing mechanism being attached to one end of the camshaft, so as to support the oil control valve.

16. The holding structure according to claim 15, wherein the shaft end portion of the valve portion protrudes below a lower portion of the support portion.

* * * * *